United States Patent [19]

Van Tol

[11] Patent Number: 4,710,672

[45] Date of Patent: Dec. 1, 1987

[54] PICTURE DISPLAY DEVICE

[75] Inventor: Maurits W. Van Tol, Almelo, Netherlands

[73] Assignee: U.S. Philips Corporation, New York, N.Y.

[21] Appl. No.: 353,315

[22] Filed: Mar. 1, 1982

[30] Foreign Application Priority Data

Apr. 16, 1981 [NL] Netherlands ..... 8101888

[51] Int. Cl.[4] ..... H01J 29/54; H01J 29/74

[52] U.S. Cl. ..... 313/413; 313/440

[58] Field of Search ..... 313/413, 414, 433, 440, 313/431, 450

[56] References Cited

U.S. PATENT DOCUMENTS

| | | | |
|---|---|---|---|
| 3,020,434 | 2/1962 | Bloomburgh | 313/440 |
| 3,136,918 | 6/1964 | Watson | 313/450 X |
| 3,979,631 | 9/1976 | van der Ven | 313/450 |
| 4,095,138 | 6/1978 | Schwartz | 315/16 |
| 4,345,183 | 8/1982 | Fukuda | 313/414 |
| 4,366,419 | 12/1982 | Barten | 313/414 |
| 4,393,329 | 7/1983 | Lehnert | 313/364 X |

*Primary Examiner*—David K. Moore
*Assistant Examiner*—Sandra L. O'Shea
*Attorney, Agent, or Firm*—Robert J. Kraus

[57] ABSTRACT

In a cathode ray tube including deflection coils for deflecting an electron beam produced in the tube by an electron gun, the center of the electron gun's focusing lens is positioned to coincide with the deflection point of the deflection coils. This positioning compensates for curvature of the deflection field.

5 Claims, 7 Drawing Figures

2-III-PHN 10.013

PICTURE DISPLAY DEVICE

BACKGROUND OF THE INVENTION

The invention relates to a picture display device comprising a cathode ray tube having in an evacuated envelope centred along an electron-optical axis a cathode and a number of lens electrodes which together constitute the electron gun for producing an electron beam. The gun has an accelerating electrostatic electron lens formed by the last two lens electrodes on the display screen side of the electron gun for focusing the electron beam onto a display screen. The cathode ray tube is surrounded by a system of deflection coils for deflecting the electron beam from the axis and across the display screen. The system of deflection coils surrounds the electron lens.

Such a picture display device is known from U.S. Pat. No. 2,151,777 in which it is suggested to place the electrostatic electron lens for focusing the electron beam onto the display screen at least partly inside the system of deflection coils to obtain a shorter device. In this case the deflection point of the system of deflection coils lies between the two major faces of the electrostatic electron lens. The location of the two major faces of the electrostatic electron lens is easy to determine from the tables in "Electrostatic Lenses", E. Harting and F. H. Read, Elsevier Scientific Publishing Company, Amsterdam-Oxford-New York 1976. This location will be further described hereinafter.

The system of deflection coils, however, has a number of electron-optical aberrations of which the most obvious are the astigmatism and the curvature of field. Curvature of field is the non-coincidence of the main surface of the image (or sometimes "surface of best focus") with the display screen. Whereas the astigmatism can be corrected substantially entirely by a correct choice of the design of the deflection coils, the radius of curvature of the main surface of the image is approximately equal to $$\frac{L\,k}{L+k} \qquad (1)$$

wherein k is the effective length of the deflection field of the deflection coils and L is the distance from the deflection point to the display screen. This deflection point is located on the electron-optical axis of the electron gun and is the point of intersection with said axis of a plane perpendicular to said axis from which, in the case of maximum deflection of the electron beam, the electrons appear to originate when viewed from the display screen. The place of said deflection point on the axis will be described in greater detail hereinafter.

It is possible to correct the curvature of field by means of dynamic focusing. The strength of the electron lens for focusing the electron beam, which lens is sometimes termed focusing lens, is adjusted as a function of the deflection to which the electron beam is subjected at that instant. As a result of this it is possible to continuously cause the main surface of the image to intersect the display screen where the electron beam impinges on the display screen. However, this manner of correcting necessitates the incorporation of an extra circuit for generating the correct dynamic focusing voltages at the electrodes of the focusing lens.

SUMMARY OF THE INVENTION

It is an object of the invention to provide a picture display device without dynamic focusing having a large resolving power and a smaller curvature of field as compared with the known tubes.

According to the invention a device of the kind mentioned in the opening paragraph is characterized in that the deflection point of the system of deflection coils coincides substantially with the centre of the electron lens.

The centre of said lens is the point in which the second derivitive of the potential variation as a function of the distance along the axis is zero.

The invention is based on the experimentally and theoretically determined recognition that an accelerating electrostatic electron lens always has a positive curvature of field, in which the convex side of the main surface of the image faces the display screen. The deflection generated by means of the deflection coils also has a positive curvature of field. By arranging the deflection point and the centre of the focusing lens to be very close together or causing them to coincide, deflection of the electron beam viewed in the direction of propagation of the electron beam takes place substantially in the second half of the focusing lens.

Viewed in the direction of propagation of the electron beam the accelerating lens may be considered as a positive lens succeeded by a negative lens. Since a negative lens has a negative curvature of field and a positive lens has a positive curvature of field, while the electron beam in the positive lens travels substantially along the axis of the lens and in the negative lens moves further away from the axis as a result of the deflection, the overall contribution of the lens to the curvature of field is negative. This negative contribution to the curvature of field partly compensates for the positive curvature of field of the deflection field. In addition the following advantageous effect is obtained. Because the focusing lens is closer to from the display screen than in tubes in which the focusing lens is situated in front of the deflection coils, the beam angular aperture on the display screen is larger with the electron beam diameter in the focusing lens remaining the same and hence aberrations remaining the same and with a given cathode load, as a result of which a smaller electron spot on the display screen is realized. This means a better resolving power.

Because the electrodes of the focusing lens are situated in the field of the deflection coils, these are preferably constructed as thin wall electrodes disposed on the inner wall of the envelope, to suppress the occurrence of eddy currents in the material of the electrodes as much as possible. Suppressing eddy currents is also possible by providing slots in metal electrodes.

The invention may be used effectively in all picture display devices having cathode ray tubes with one electron beam and magnetic deflection, for example, monochromatic television tubes, certain colour television tubes (chromatrons and penetrons) and in particular in projection television display devices.

BRIEF DESCRIPTION OF THE DRAWING

The invention will now be described in greater detail, by way of example, with reference to a drawing, in which.

DESCRIPTION OF THE PREFERRED EMBODIMENTS

Figure 1:
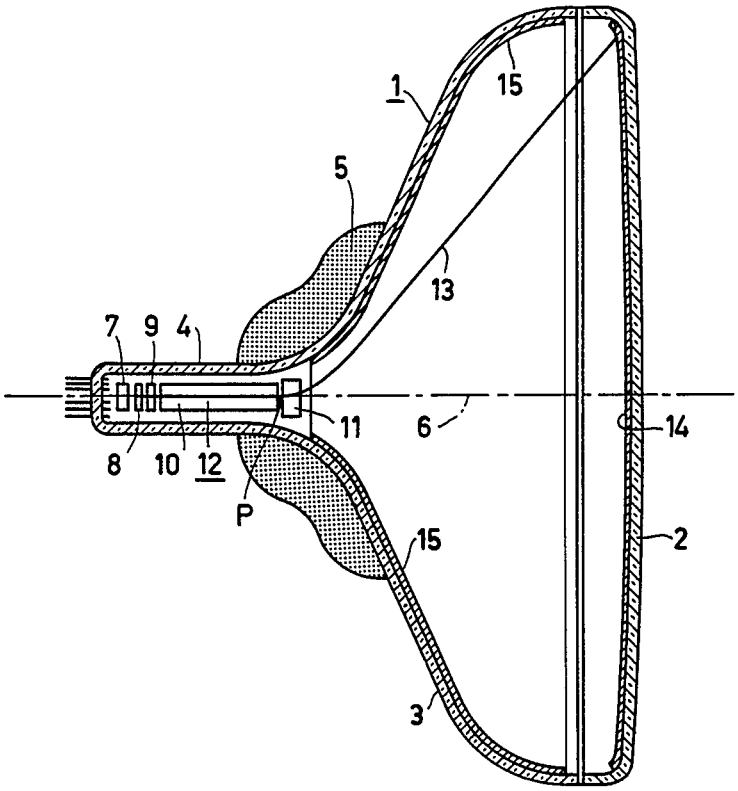
FIG. 1 is a sectional view of a picture display device according to the invention, FIG. 2 further explains the concept deflection point, FIGS. 3*a* to 3*d* diagrammatically further explain the invention.

The device shown in FIG. 1 comprises a cathode ray tube consisting of inter alia a glass envelope 1 which is composed of a display window 2, a conical portion 3 and a neck 4. A number of electrodes 8, 9, 10 and 11 are placed in said neck and together with the cathode 7 constitute the electron gun 12. The electron-optical axis 6 of the electron gun is also the axis of the envelope. The electron beam is successively formed and accelerated by the cathode 7 and the electrodes 8, 9, 10 and 11. The electrodes 10 and 11 form the focusing lens which focuses the beam onto the display screen 14 on the inside of the display window 2. Typical applied voltages are:

| | |
|---|---|
| cathode 7 | 50 V |
| electrode 8 | 0 V |
| electrode 9 | 500 V |
| electrode 10 | 7 kV |
| electrode 11 | 30 kV |

In general the potential of the second lens electrode (11) is a factor 2 to 10 higher than the potential of the first lens electrode (10). The electron beam 13 is deflected from the axis 6 across the display screen 14 by means of the system of deflection coils 5. Display screen 14 consists of a phosphor layer covered with a thin aluminium film which is connected electrically to electrode 11 via the conductive coating 15 on the inner wall of the conical portion. According to the invention the deflection point P of the system of deflection coils 5 must coincide substantially with the centre of the focusing lens formed by the electrodes 10 and 11 to compensate for the curvature of field of the system of deflection coils. What the deflection point is and why coincidence is important will be described in greater detail with reference to FIGS. 2 and 3*a* to *d*.

Figure 2:
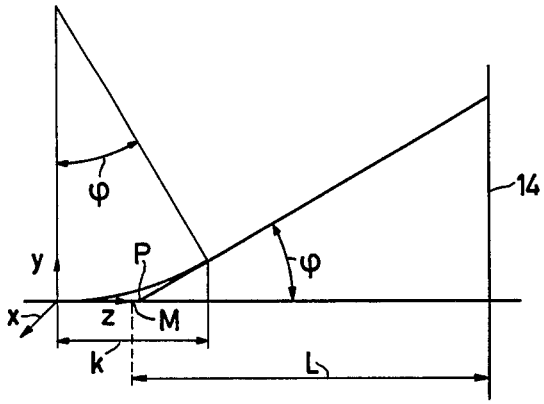

FIG. 2 further illustrates the concept deflection point. The electron path is deflected in a magnetic field having a length k as shown. For simplicity said field is assumed to be homogeneous. In the figure the magnetic field is perpendicular to the plane of the drawing and is directed away from the plane of the drawing. At the beginning of the field intersecting axes are shown. The electrons moving in the z-direction obtain a velocity component in the y-direction as a result of the force excerted on them and start describing a curved path and in the case of a homogeneous magnetic field a circular path. The electrons leaving the field travel along a line tangential to said path. The tangential line makes a maximum angle $\phi$ with the electron-optical axis, the so-called deflection angle. The point of intersection of said tangential line with the axis is termed the deflection point P. The distance from the point P to the centre M of the homogeneous magnetic field can be determined from the equation:

$$k \cdot \frac{1 - \cos\phi}{2(1 + \cos\phi)} \qquad (2)$$

For small deflection angles, P and M coincide, while at large deflection angles, P moves towards the display screen to a small extent. For example, for $\phi = 45°$, the maximum deflection in a 90° display tube, the displacement of P=0.086k.

Of course the electron beam has a certain diameter. Therefore this may also be referred to as a deflection plane. Said deflection plane is obtained by determining the plane of intersection of the non-deflected electron beam with the maximum deflected electron beam elongated in the rearward direction. The point of intersection of said deflection plane with the axis is the deflection point. The location of the deflection point of most commercially available deflection coil units is accurately known. The location of the deflection point can also be determined accurately by elongating the central path (axis) of the deflected electron beam to the tube axis and determining the point of intersection.

Figure 3A:
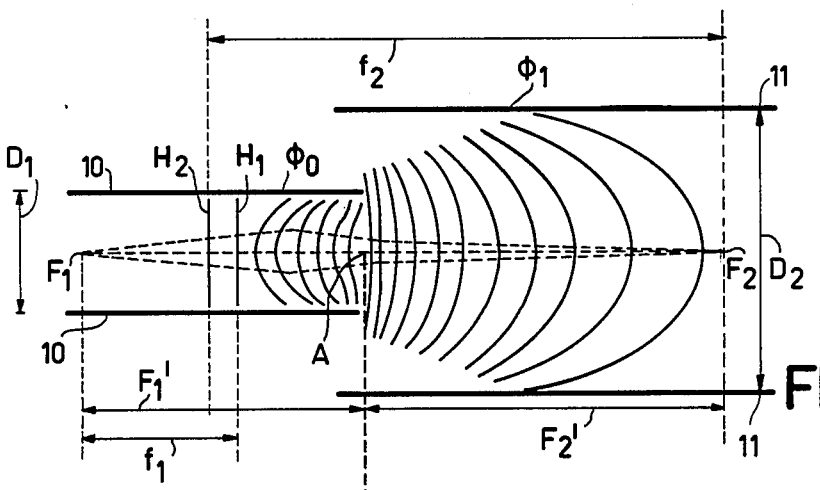

FIG. 3*a* shows diagrammatically a focusing lens of an electron gun. Two cylindrical metal electrodes 10 and 11 have the potentials $\phi_o$ and $\phi_1$ and diameters $D_1$ and $D_2$, respectively. The curved lines denote the lines of intersection of the equipotential planes between the electrodes with the plane of the drawing. Each potential plane represents a plane having an equal refractive index. The centre of the lens is the point A. This is the point in which the second derivitive of the potential variation as a function of the distance along the axis is zero. (see FIG. 3*c*). The focal distances $f_1$ and $f_2$ are the distances between the focus $F_1$ and the first major face $H_1$ and the distance between the focus $F_2$ and the second major face $H_2$, respectively. The foci $F_1$ and $F_2$ are situated at distances $F'_1$ and $F'_2$, respectively, from the centre A. The distance from the centre A to the first major face $H_1$ thus is $F'_1 - f_1$. It follows from the tables in the already mentioned "Electrostatic Lenses" that even for extreme potential ratios and diameter ratios $D_2/D_1$ the first major face $H_1$ is situated at a distance of at least $0.6 \times D_1$ of the centre A. (see tables A1, 11, A1,23 and A1,27).

Figure 3B:
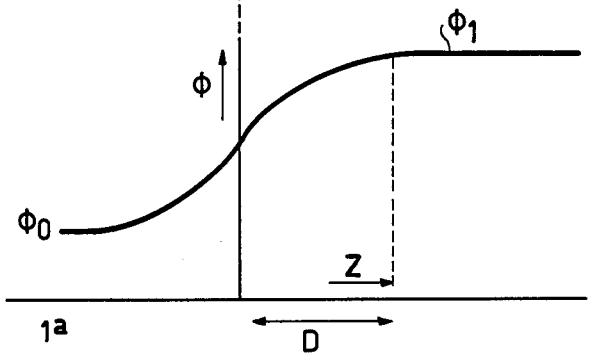

FIG. 3*b* shows diagrammatically the potential ($\phi$) variation in arbitrary units as a function of the distance in the z-direction.

Figure 3C:
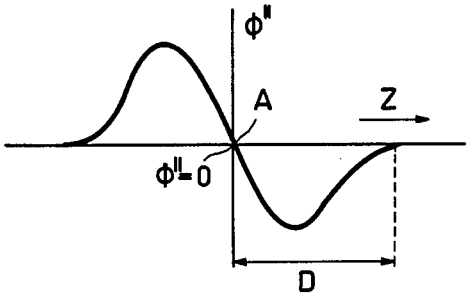

FIG. 3*c* shows the variation of the second derivitive of the potential variation $\phi''$ as a function of the distance along the z-axis.

An electron-optical system which has been corrected for astigmatism has a curvature of field which, according to the optical analogy, is termed Petzval curvature and which for an electrostatic electron lens is characterized by a radius of curvature $\rho_p$ where $$\frac{1}{\rho} = \frac{\sqrt{\phi_1}}{4} \int_{z_0}^{z_1} \phi''/\phi^{3/2} dz \qquad (3)$$

In this formula $\phi$ and z are the potential and the coordinate along the axis of the electron lens, respectively, and the indices 0 and 1 indicate the value at the area of object and picture.

Figure 3D:
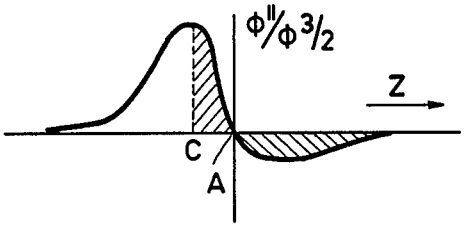

FIG. 3*d* shows the variation of the integrand. From this it may be seen that an electrostatic lens always has a positive curvature of field (the integral is positive). However, when the electron beam is deflected mainly from the point C from the axis, then only the part on the right of said point contributes to the radius of curvature and the focusing lens gives a negative contribution to the curvature of field. The shaded areas on the right and on the left of the centre have equal areas so that the negative value of the integral becomes larger and larger on the right from C up to the centre A. On the right of A the negative value of the integral again decreases to zero. This negative contribution which is maximum in the centre A compensates the positive curvature of field of the deflection field.

It has been found that the point C is situated at a distance of at most 0.4 $D_1$ from the centre A for a voltage ratio $\phi_1/\phi_o$ of 2. Since the first major face $H_1$ is situated at a distance of at least 0.6 $D_1$ from the centre A, the deflection point in a device according to the invention hence never is between the major faces $H_1$ and $H_2$. For a larger voltage ratio the point C is situated nearer to the centre A.

The electron spot in a device in accordance with the invention has been found to obtain considerably less defocusing as a result of curvature of field. Moreover, the electron spot on the display screen proves to be smaller after deflection than in comparable tubes in which the invention is not used.

Because the electrodes of the focusing lens are situated in the system of deflection coils and hence in a strongly varying magnetic field, measures have to be taken to suppress eddy currents. This may be done by providing the electrodes with a large number of slots as a result of which the surface in which the currents can occur is restricted. These slots have no influence on the potential within the electrode and hence the focusing.

Figure 4:
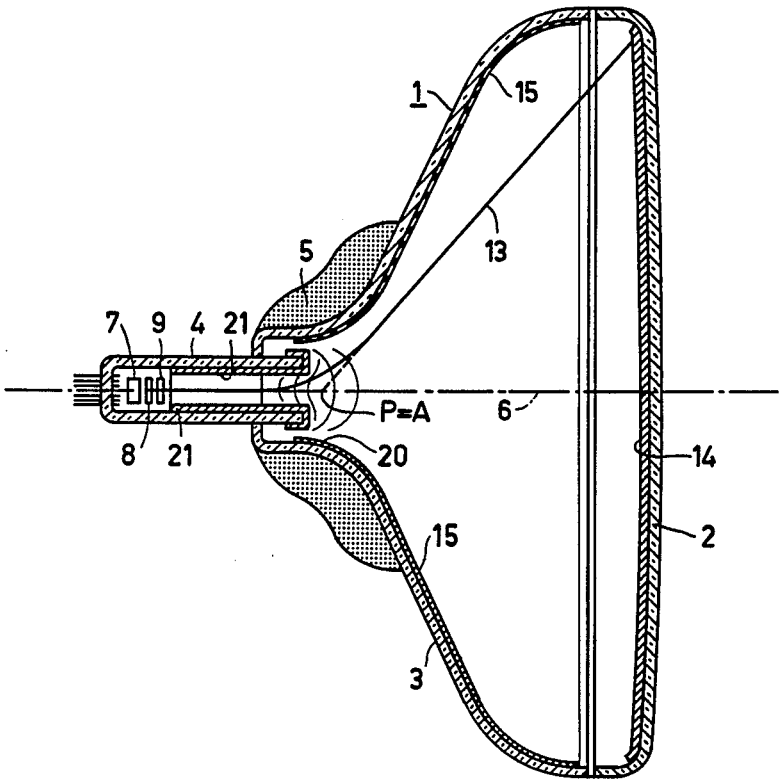
FIG. 4 is a sectional view of another embodiment of a picture display device in accordance with the invention.

It is also possible, however, as shown in FIG. 4, to form the focusing lens from thin wall electrodes 20 and 21. The wall electrode 20 is formed by the end of the conductive coating 15. For the meanings of the remaining reference numerals see the description of FIG. 1.

The deflection point P is found by elongating the straight path of the electron beam 13 from the display screen 14 and determining the point of intersection P with the axis 6. According to the invention this deflection point P must coincide substantially with the centre of the focusing lens formed by the wall electrodes 20 and 21.

What is claimed is:

1. A cathode ray tube comprising an evacuated envelope containing an electron gun, centered on an electron optical axis of the tube, and further comprising deflection coil means mounted on the envelope for effecting deflection of an electron beam produced by the electron gun to paths along lines intersecting a deflection point on the axis, characterized in that the electron gun includes a plurality of electrodes positioned along the axis to effect formation of an accelerating electrostatic lens system comprising, in the direction of propagation of the electron beam, a positive lens followed by a negative lens, said deflection point being centrally located between opposing faces of said lenses.

2. A cathode ray tube as in claim 1 where the plurality of electrodes comprises first and second coaxial electrodes for forming the positive lens and the negative lens, respectively.

3. A cathode ray tube as in claim 1 or 2 where the electrodes are configured to limit eddy currents.

4. A cathode ray tube as in claim 3 where the electrodes comprise conductive coatings disposed on inner surfaces of the envelope.

5. A cathode ray tube as in claim 1 or 2 where said tube is a projection tube.

* * * * *